United States Patent [19]

Eargle, Jr. et al.

[11] 4,403,277

[45] Sep. 6, 1983

[54] INDUSTRIAL LIGHTING ILLUMINATION

[75] Inventors: William R. Eargle, Jr.; Winfried N. Westermann, both of Vicksburg, Miss.

[73] Assignee: Cooper Industries, Inc., Houston, Tex.

[21] Appl. No.: 229,897

[22] Filed: Jan. 30, 1981

[51] Int. Cl.[3] ..... F21V 7/00; F21V 17/00; F21V 19/02

[52] U.S. Cl. ..... 362/263; 174/50; 362/277; 362/285; 362/296; 362/368; 362/439

[58] Field of Search ..... 362/257, 263, 277, 282, 362/296, 306, 408, 416, 418, 433-440, 443, 448, 449, 451, 453, 454; 174/50 R, 61

[56] References Cited

U.S. PATENT DOCUMENTS

| | | | |
|---|---|---|---|
| 1,849,966 | 3/1932 | Ureles | 362/439 X |
| 1,876,877 | 9/1932 | Douglas | 362/306 |
| 3,404,269 | 10/1968 | Schiffer et al. | 362/263 |
| 3,432,629 | 3/1969 | Field et al. | 362/296 X |
| 3,511,984 | 5/1970 | Blaisdell et al. | 362/277 |
| 3,919,459 | 11/1975 | Van Steenhoven | 174/50 X |
| 3,986,019 | 10/1976 | de Vos et al. | 362/367 |
| 4,173,037 | 10/1979 | Henderson et al. | 362/277 X |
| 4,237,528 | 12/1980 | Baldwin | 362/263 |

*Primary Examiner*—David H. Brown
*Attorney, Agent, or Firm*—Wigman & Cohen

[57] ABSTRACT

An industrial lighting luminaire including a ballast housing, a reflector and a reflector support securing the reflector to the ballast housing. The transformer forms a portion of the outer surface of the ballast housing which is adapted to accommodate transformers of varying size and the reflector support forms a hinge-like snap closable connection with the reflector. A mounting plate hooks onto and forms a top cover for the ballast housing.

8 Claims, 9 Drawing Figures

INDUSTRIAL LIGHTING ILLUMINATION

BACKGROUND OF THE INVENTION

Industrial lighting fixtures or luminaires are employed in almost every type of industrial application, whether it be steel mills, electronic assembly, forging operations, machine shops or the like. Industrial lighting luminaires are generally designed to operate mercury, metal halide or high pressure sodium lamps in a variety of industrial applications. Ease of installation is an important factor in the design of industrial lighting fixtures since they are generally mounted adjacent the ceiling in what can be extremely high work areas, as for example high bay storage areas. Additionally, the reflectors should have the facility to be quickly and easily removed for purposes of cleaning. Of course, simplicity in construction and reduction in materials is always important with respect to manufacturing costs of commercial products.

U.S. Pat. No. 3,511,984 issued May 12, 1970 to R. G. Blaisdell et al. for a "Lighting Fixture" is illustrative of one type of hinged latching mechanism for interconnecting a reflector to an industrial lighting fixture.

U.S. Pat. No. 3,919,459 issued Nov. 11, 1975 to F. Van Steenhoven for "Luminaire Ballast Mounting System" is illustrative of one means for mounting the ballast housing of an industrial luminaire and further discloses the separation of the transformer and capacitor ballast compartments to provide a low profile industrial luminaire.

U.S. Pat. No. 3,986,019 issued Oct. 12, 1976 to de Voss et al. for "Lighting Fixture" discloses a ballast housing mounting system in an industrial luminaire which employs a pair of hinges at each end of the luminaire to permit the top cover and sides of the ballast housing to pivot away for purposes of mounting as well as access to the wiring compartment of the ballast housing.

SUMMARY OF THE INVENTION

The industrial lighting luminaire of this invention employs a pivotal top cover and mounting plate which provides access to the wiring compartment without the use of any tools to gain such access and further provides for the simple release and removal of the dependent reflector from the ballast housing again without the use of any tools. Additionally, the ballast housing can accommodate transformers of differing size with similar side compartments regardless of the varying size of the transformer since the transformer forms a portion of the outer front and rear walls of the ballast housing.

The foregoing is provided in an industrial lighting luminaire by providing a ballast housing, a reflector and a reflector support securing the reflector to the ballast housing in which the reflector has a dome shape and a central socket receiving aperture in the top thereof and a pair of smaller apertures adjacent the central aperture. The reflector support includes a pair of adjustable latch means having tab means and spring clip means on the ends thereof constructed and arranged to extend through said central aperture in the reflector with said tab means extending back through each of the smaller apertures in the reflector to thereby support one side of the reflector while said spring clip means interact with the edge of the central aperture to thereby support the other side of the reflector. Furthermore, the ballast housing includes a transformer and a pair of side housing compartments secured to the transformer with the transformer forming a part of the front and rear exterior surfaces of the ballast housing. Additionally, a combination top cover and mounting plate pivots in a slot in the ballast housing back cover and forms both a top cover and front cover for a wiring compartment as well as removable mounting means for the ballast housing itself.

BRIEF DESCRIPTION OF THE DRAWING

Many of the attendant advantages of the present invention will become more readily apparent and better understood as the following detailed description is considered in connection with the accompanying drawing in which.

DESCRIPTION OF THE PREFERRED EMBODIMENT

Figure 1:
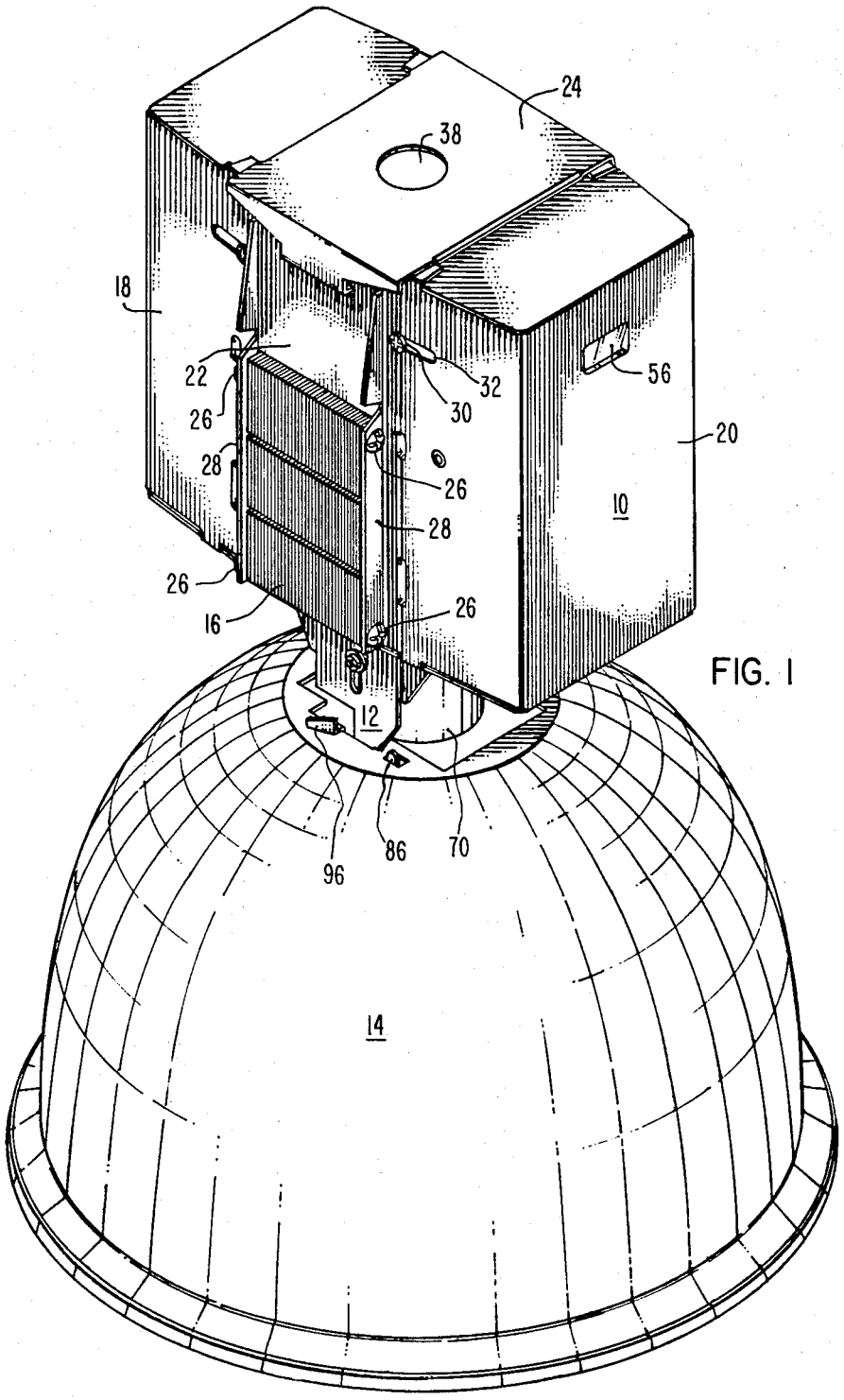
FIG. 1 is a perspective view of the industrial lighting luminaire of this invention.

Referring now in detail to the drawing wherein like reference characters represent like parts throughout the several views, there is illustrated in FIG. 1 the industrial lighting luminaire of this invention including a ballast housing, a reflector support and a reflector generally designated 10, 12 and 14, respectively. The central structural member of the ballast housing 10 is the transformer 16 which may vary in size depending on the wattage and type of lamp to be utilized by the particular fixture. Although the size of the transformer 16 may vary depending on whether the system is designed to operate a 250 watt or 400 watt high-pressure sodium, mercury, or metal halide discharge lamp, the remainder of the ballast housing components remain identical in size and shape even though the outer configuration of the entire structure may vary slightly. As viewed from FIG. 1, a pair of side housing compartments, right side compartment 18 and left side compartment 20, house the starter and capacitor respectively. A back cover plate 22 closes off the rear of the wiring compartment which overlies the transformer while a combination top cover and mounting plate 24 serves to close off both the top and front side of the wiring compartment as well as act as a removable mounting plate for the luminaire.

Figure 2:
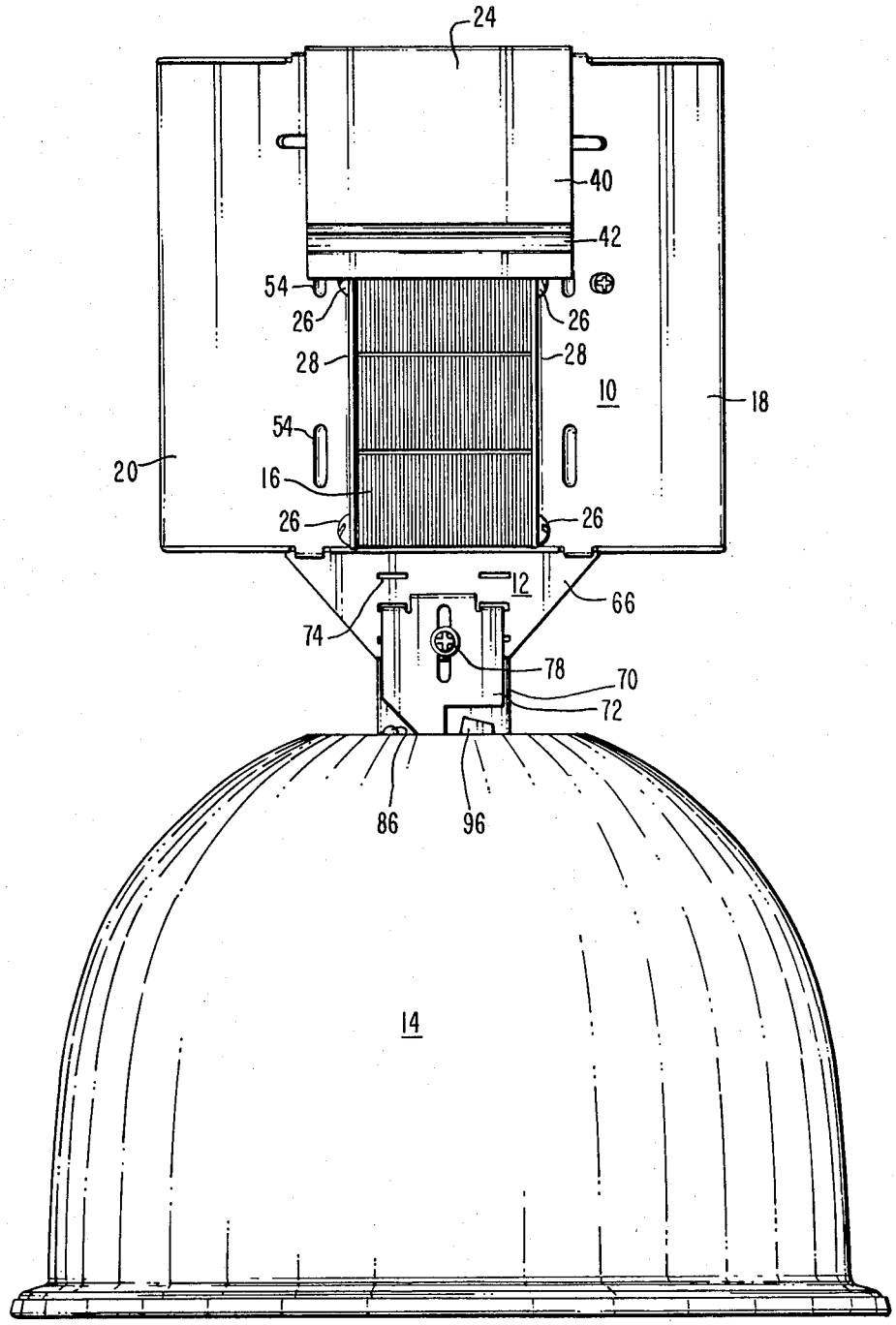
FIG. 2 is a front elevation view thereof.

The right and left side housing compartments 18 and 20 are secured directly to the transformer 16 by means of threaded bolts 26 which extend through flanges 28 on the side housing compartments and are received in threaded apertures (not shown) in the transformer 16. The back cover 22 is situated above the transformer 16 and closes off the rear of the wiring compartment. The back cover 22 is secured to the side compartments 18 and 20 by means of screws 30 which extend through elongated slots 32 in the side compartment covers 18 and 20 and are threaded into the back cover 22. As will be seen in phantom lines in FIG. 4 and in FIG. 5 in full, the back cover 22 extends for a substantial distance behind the side walls of the side housing compartments 18 and 20 and the elongated slots 32 permit essentially the same back cover to be utilized in connection with wider transformers. The back cover 22 includes an elongated slot 34 shown therein in FIG. 4 into which the re-entrant flange 36 of the top cover and mounting plate 24 is received. The re-entrant flange 36 shown in FIG. 3 extends substantially parallel with the top surface of the top cover 24 and serves in conjunction with the slot 34 in the back wall as a hinge for the combination top cover and mounting plate 24. As shown in FIG. 1, the top cover is provided with a circular aperture 38 in the center thereof for mounting the top cover and mounting plate 24 to a conventional conduit or outlet box. As shown in FIG. 2, a resilient front cover portion 40 which closes off the front of the wiring compartment includes an elongated substantially V-shaped latching portion 42, best shown in FIG. 3, which is adapted to snap into a recess or cut-out portion 44 defined by the flanges 28 and upper flanges 46 on the side housing compartments to releasably retain the top cover and mounting plate 24 in a closed position.

Figure 4:
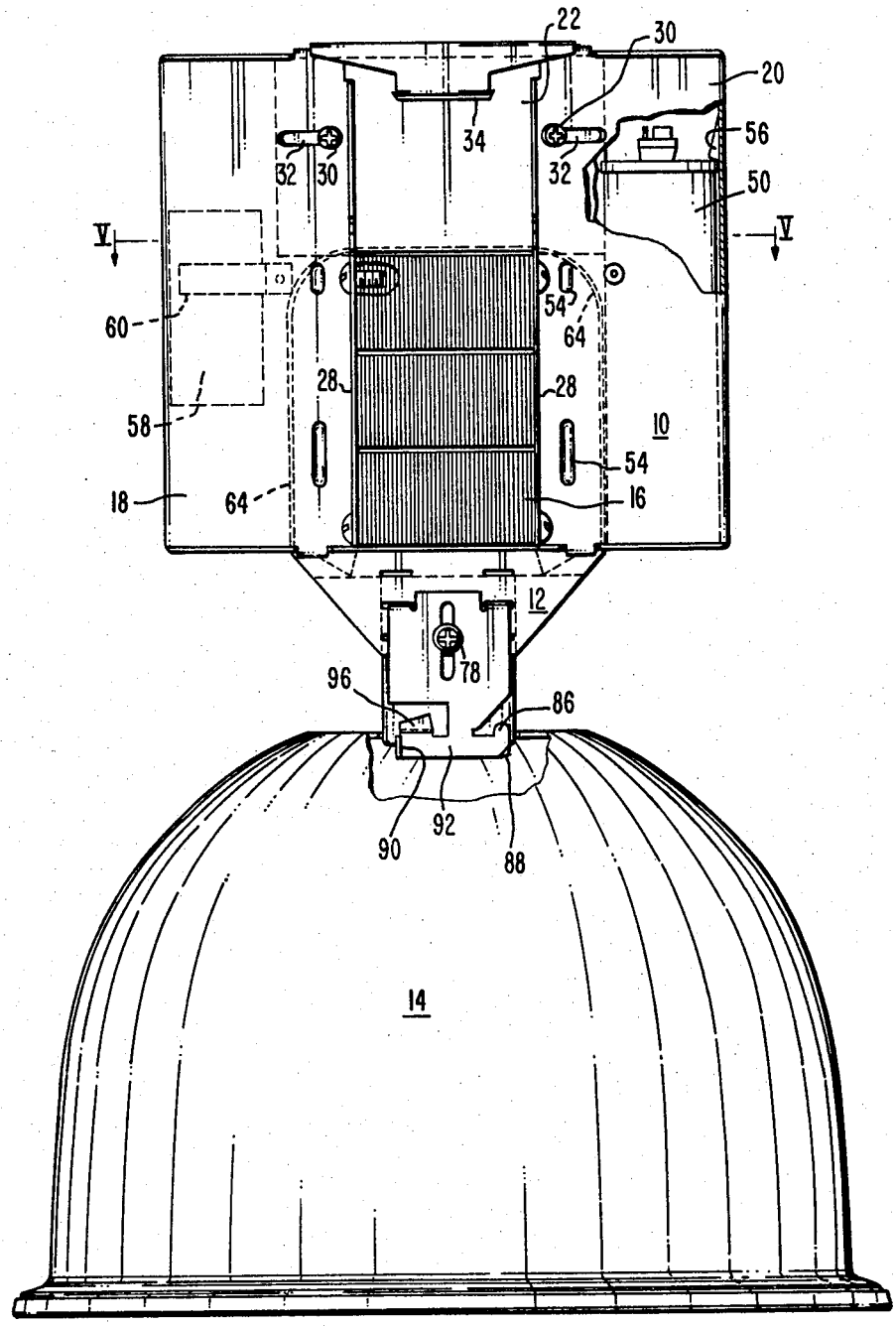
FIG. 4 is a rear elevation view thereof.
Figure 5:
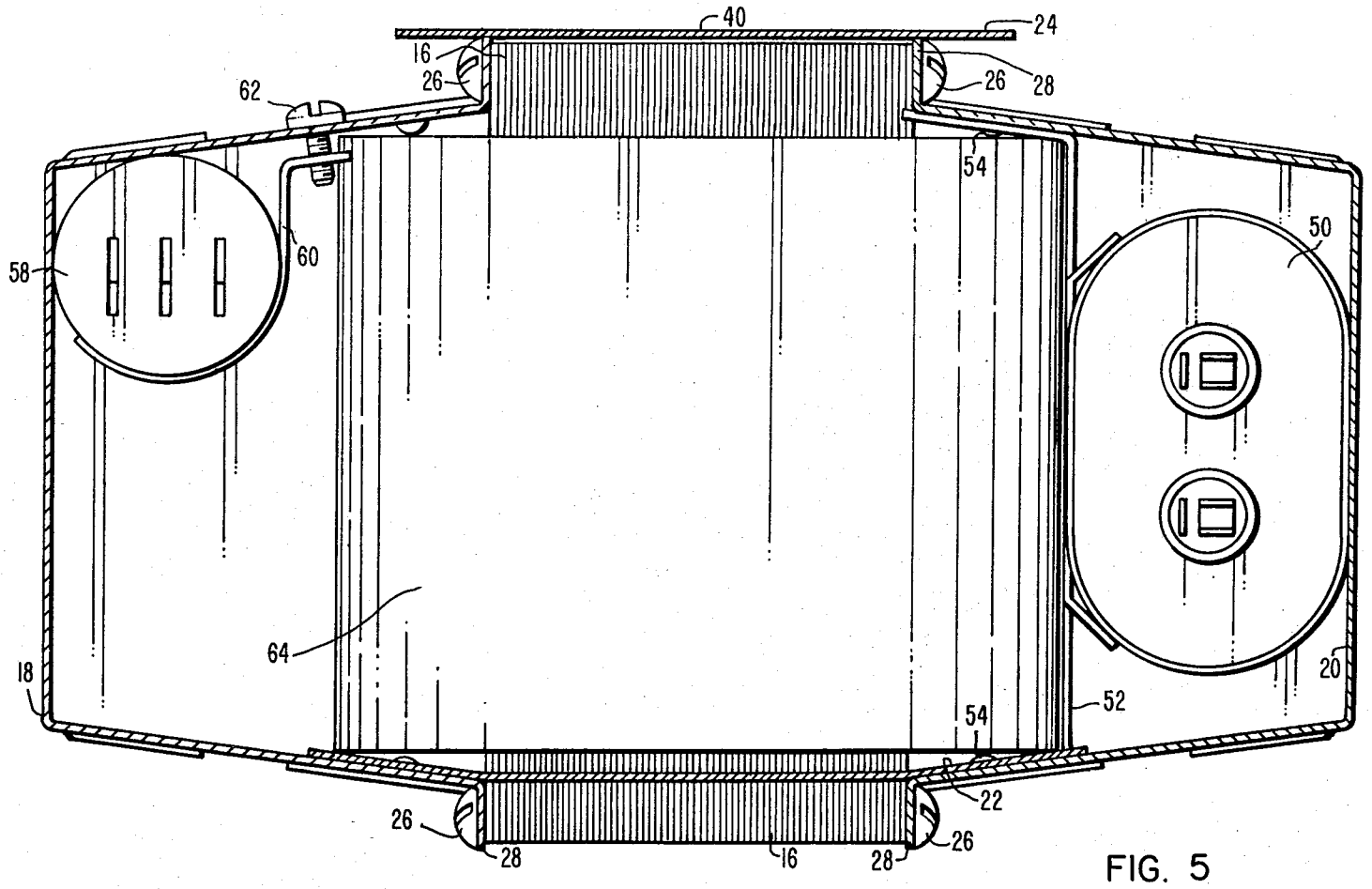
FIG. 5 is a sectional view taken along the line V—V of FIG. 4.
Figure 6:
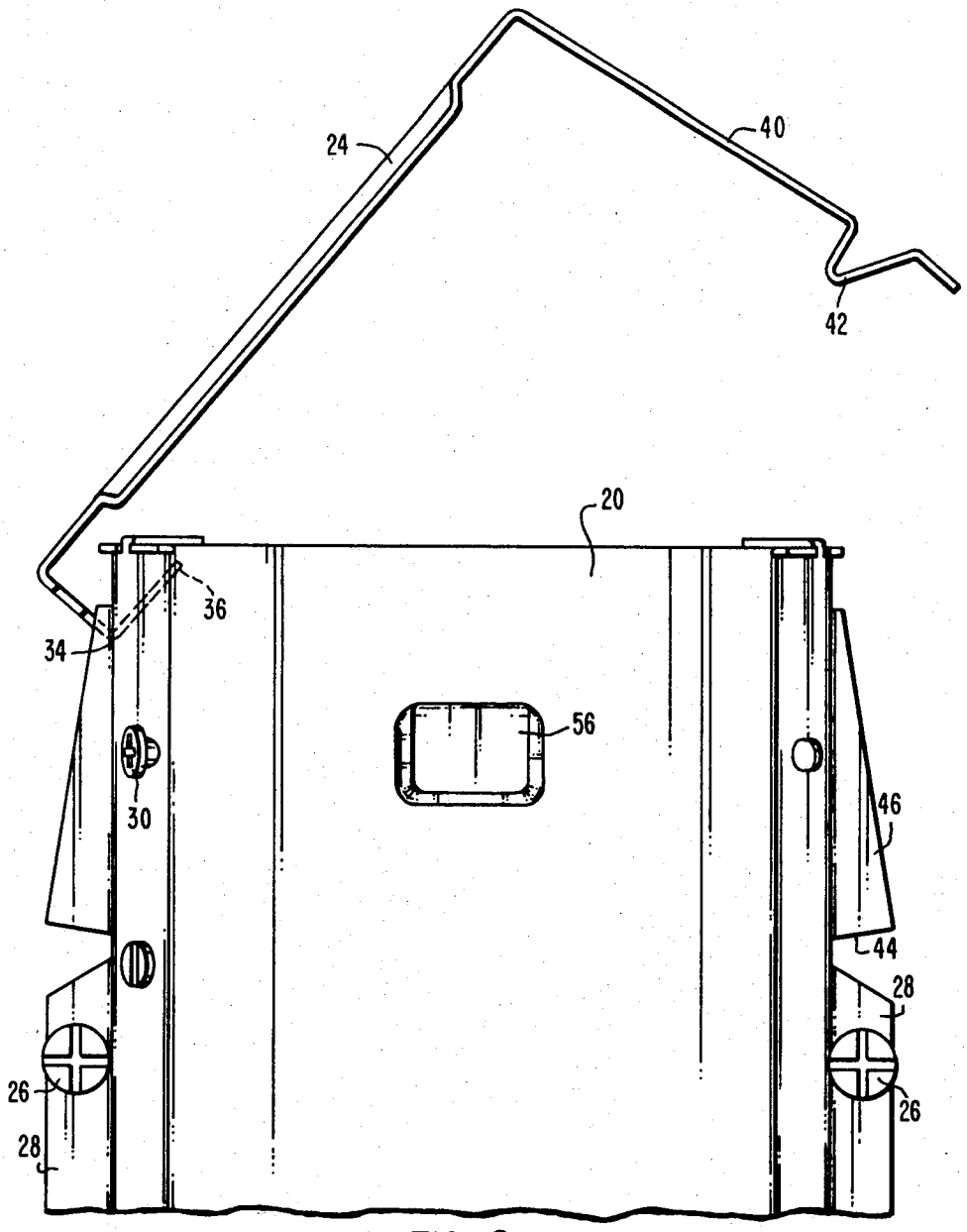
FIG. 6 is an enlarged view of the upper half of a side elevation view of the luminaire housing with the top cover and mounting plate pivoted away.

The side housing compartment 20 houses the capacitor 50, shown in FIG. 5, which is retained in place by capacitor retaining member 52 which is maintained in position by apertures therein snapping over detents 54 on the internal surface of the side compartment housing 20. Additionally, as best seen in FIG. 4, a depression 56 in the end wall of the side compartment 20 overlies the upper surface of the capacitor 50. In the side compartment 18, the starter 58 is mounted therein by the starter bracket 60 which is secured to the side wall of the compartment 18 by a bolt 62.

The capacitor 50, the starter 58 and the wiring compartment are protected from heat generated by the transformer 16 by a U-shaped heat shield 64 which is a high temperature resistant organic fiber sheet material, for example, an aromatic polyamide fiber which is illustrated in phantom lines in FIG. 4 and shown in full view in FIG. 5.

Figure 3:
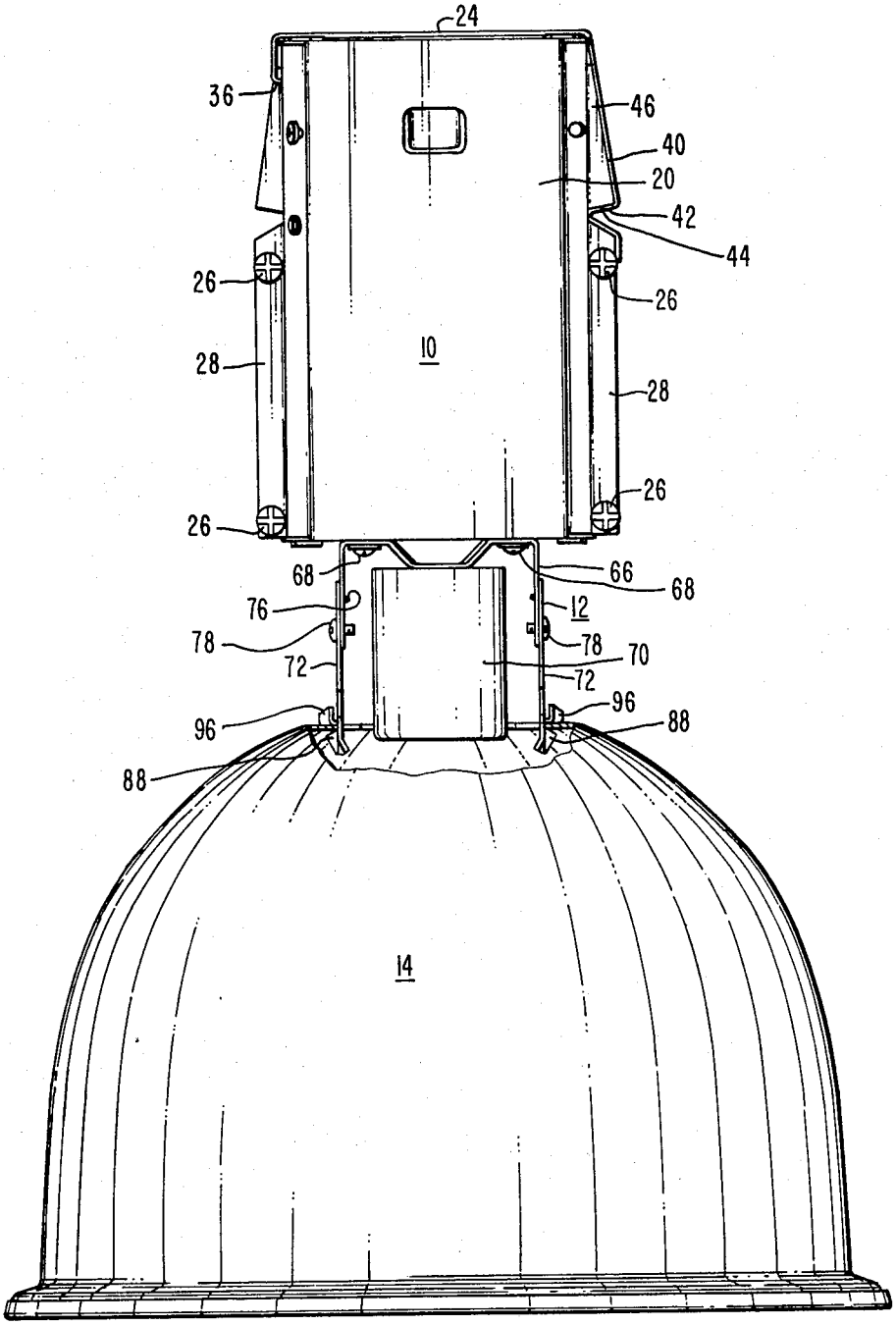
FIG. 3 is a side elevation view thereof.
Figure 7:
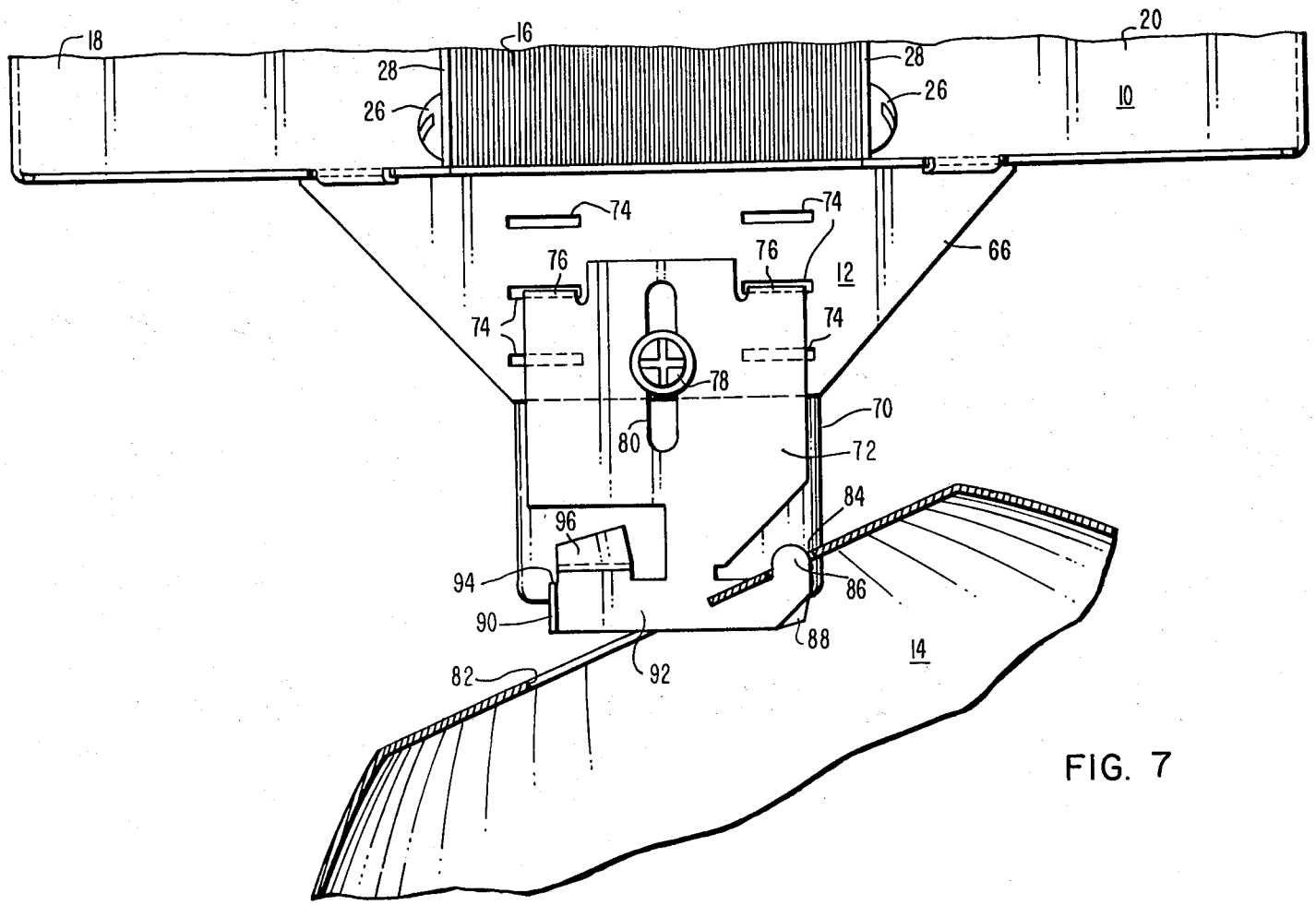
FIG. 7 is an enlarged view partly in section of the reflector mount support and a partially removed reflector.
Figure 8:
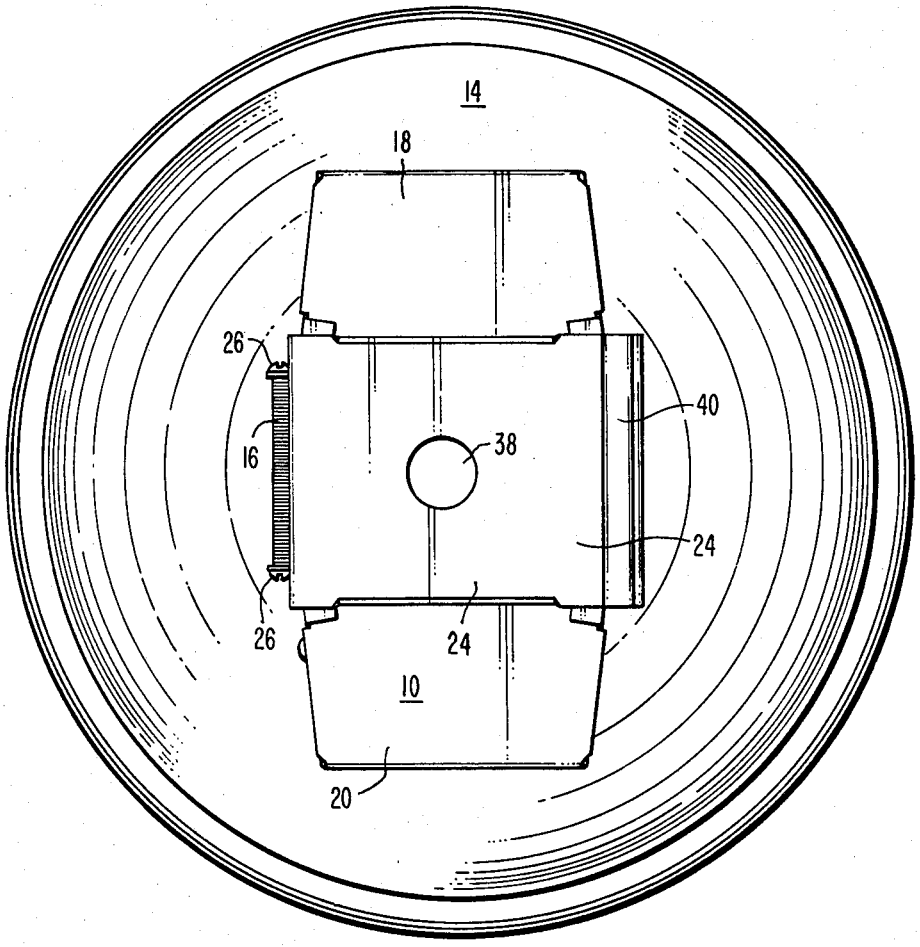
FIG. 8 is a top plan view of the industrial lighting luminaire of this invention.
Figure 9:
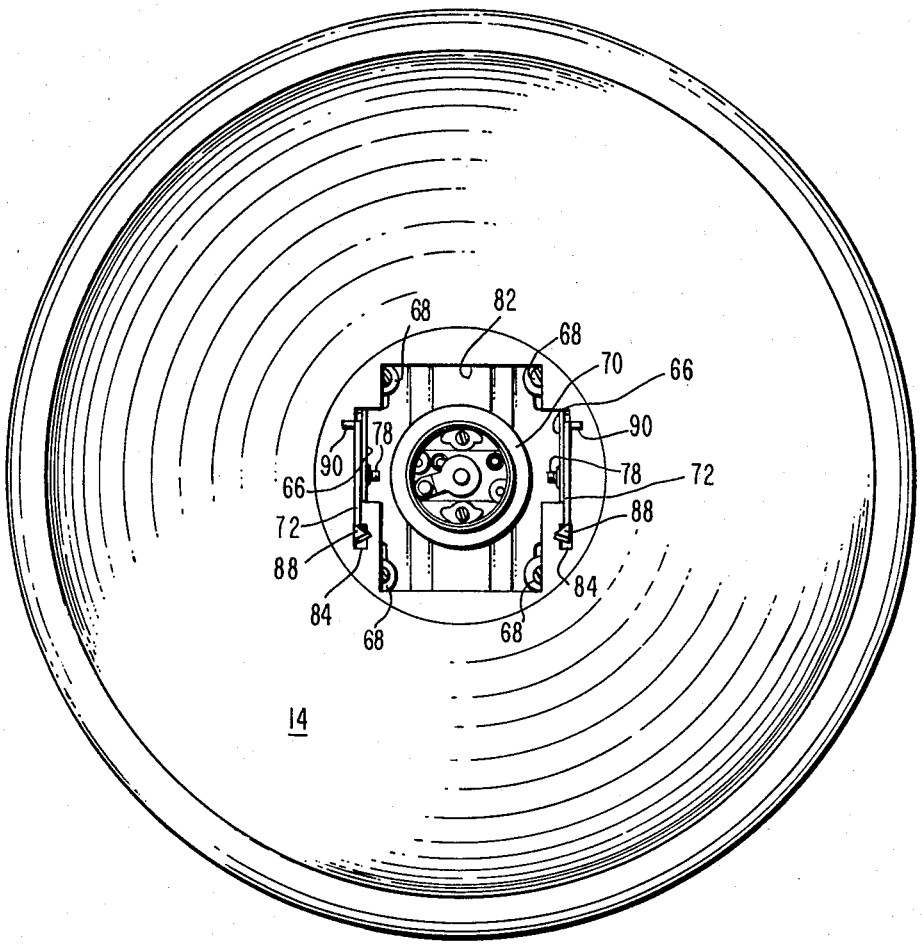
FIG. 9 is a bottom plan view thereof.

As best shown in FIGS. 2 and 3, the reflector support 12 includes a reflector latch support and socket mounting member 66 which is secured to the underside of the side housing compartments 18 and 20 by screws 68 and has centrally mounted thereon lamp socket 70. A pair of dependent latch members 72 are variably positionable on the latch support member 66 by means of slots 74 on the latch support and detents 76 on the upper end of each of the latch members 72. Screws 78 extend through an elongated slot, shown in FIG. 7, 80 in the latch members 72 and secure the latch members 72 with respect to the latch support 66. As best seen in FIG. 7, the reflector may thus be positioned relative to a lamp in lamp socket 70 in at least three different positions thereby providing for a plurality of different light distribution patterns.

The reflector 14 is dome-shaped and includes a large central aperture 82 therein and a pair of adjacent small apertures 84. The latch members 72 are of spring steel and provide for a hinging action when mounting the reflector 14 to the latch members 72. The latch members 72 include upwardly directed, upturned tabs 86 which extend through the small apertures 84 with undertabs 88 limiting the extent of entry and aiding in support of the reflector 14 while at the other edge of each of the latch members 72 are cam latch fingers 90 which flex the arms 92 of each of the latch members 72 inwardly as the large aperture 82 rides up over the outwardly directed cam surface and snaps over the top edge 94 of the cam latch fingers 90 to thereby support and retain the other side of the reflector 14. Finger tabs 96 are provided on the arms 92 above the (cam latch) fingers 90 to provide for the inward flexure of the arms 92 to thereby remove the upper edge 94 of the cam latch fingers 90 out of retaining contact with the reflector 14 and permit the reflector 14 to be swung away as best illustrated in FIG. 7.

As will be apparent from the foregoing, the industrial lighting luminaire of this invention provides a ballast housing configuration which is adapted to accommodate varying sizes of transformers while utilizing the transformer as a portion of the outer surface of the ballast housing thus aiding in the dissipation of heat created by the transformer. Furthermore, the ballast housing reflector support and reflector forming this novel luminaire is easily mounted through a mounting plate which forms the top cover and front cover to the wiring compartment as well as providing hingeable access to the wiring compartment through the single top cover and mounting plate element. Additionally, a novel mounting and retaining configuration is provided for attaching the reflector to the reflector support in which the reflector can be easily removed for cleaning purposes and the like without the need for tools to perform that function and yet provide for the positive securing of the reflector to the reflector support during operation of the luminaire.

What is claimed is:

1. An industrial lighting luminaire comprising in combination, a ballast housing, a reflector and a reflector support securing said reflector to said ballast housing, said ballast housing including a transformer and a pair of side housing compartments secured to said transformer, said transformer forming a part of the front and rear exterior surfaces of said ballast housing.

2. The industrial lighting luminaire according to claim 1 wherein said reflector has a dome shape and a central socket receiving aperture in the top thereof and a pair of smaller apertures adjacent said central aperture, said reflector support including a pair of adjustable latch means including at least one upturned tab means and at least one finger tab means on the ends thereof constructed and arranged to extend through said central socket receiving aperture in said reflector, said upturned tab means extending back through each of said smaller apertures in said reflector thereby supporting one side of said reflector, said finger tab means interacting with the edge of said central socket receiving aperture to thereby support the other side of said reflector.

3. The industrial lighting luminaire according to claim 2 wherein said pair of adjustable latch means is adjustable relative to said ballast housing to provide differing light distribution patterns from said luminaire.

4. An industrial lighting luminaire according to claim 1 wherein said ballast housing further includes a back cover secured between said pair of said housing compartments and overlying said transformer, said back cover including an elongated slot therein; and a combination top cover and mounting plate including a re-entrant flange extending through said slot in said back cover forming a hinge for said top cover.

5. An industrial lighting luminaire according to claim 4 wherein said top cover also includes an overhanging front cover portion, whereby said front cover portion, in combination with said back cover, defines a wiring compartment between said pair of side housing compartments.

6. An industrial lighting luminaire according to claim 5 wherein said front cover portion of said top cover includes an elongated V-shaped latching portion and said side housing compartments include flanges thereon having recesses therein, whereby said top cover is latched in a closed position by the interaction of said elongated V-shaped latching portion and said recesses in said flanges.

7. An industrial lighting luminaire comprising in combination, a ballast housing, a reflector and a reflector support securing said reflector to said ballast housing; said ballast housing including a combination top cover and mounting plate element having a re-entrant flange on one end thereof and a V-shaped latching means on the end remote from said re-entrant flange, a slot in one side of said ballast housing and a pair of flanges on the other side of said ballast housing, said flanges including a recess therein; said re-entrant flange insertable in said slot to form a hinge therewith and said V-shaped latching means adapted to coact with said recesses in said flanges to secure said top cover and mounting plate to the remainder of said ballast housing.

8. The industrial lighting luminaire according to claim 7 wherein said top cover and mounting plate includes a central aperture therethrough for mounting said luminaire.

* * * * *

UNITED STATES PATENT AND TRADEMARK OFFICE

CERTIFICATE OF CORRECTION

PATENT NO. : 4,403,277

DATED : September 6, 1983

INVENTOR(S) : William R. Eargle, Jr.; Winfried N. Westermann

It is certified that error appears in the above—identified patent and that said Letters Patent is hereby corrected as shown below:

IN THE CLAIMS:

Claim 4, line 63, "said" (second occurrence) should read --side--.

Signed and Sealed this

*Seventh* Day of *August 1984*

[SEAL]

*Attest:*

GERALD J. MOSSINGHOFF

*Attesting Officer*

*Commissioner of Patents and Trademarks*